US006079127A

United States Patent [19]

Nishimura et al.

[11] Patent Number: 6,079,127

[45] Date of Patent: Jun. 27, 2000

[54] GOLF SHOE AND ITS SPIKE

[75] Inventors: Toshinori Nishimura, Hiratsuka; Kosei Suzuki; Masahiko Nagahama, both of Tokyo, all of Japan

[73] Assignee: The Yokohama Rubber Co., Ltd, Tokyo, Japan

[21] Appl. No.: 09/236,106

[22] Filed: Jan. 25, 1999

[30] Foreign Application Priority Data

Jan. 26, 1998 [JP] Japan ..... 10-012716

[51] Int. Cl.[7] ..... A43B 5/00; A43C 15/00

[52] U.S. Cl. ..... 36/61; 36/134; 36/67 C

[58] Field of Search ..... 36/61, 67 R, 67 A, 36/67 D, 127, 134, 59 A, 59 C, 59 R

[56] References Cited

U.S. PATENT DOCUMENTS

| | | | |
|---|---|---|---|
| 1,361,078 | 12/1920 | Lynn | 36/61 |
| 5,289,647 | 3/1994 | Mercer | 36/61 |
| 5,299,369 | 4/1994 | Goldman | 36/61 |
| 5,351,422 | 10/1994 | Fitzgerald | 36/61 |
| 5,533,282 | 7/1996 | Kataoka et al. | 36/134 |
| 5,634,283 | 6/1997 | Kastner | 36/61 |
| 5,727,340 | 3/1998 | Suk | 36/134 |
| 5,732,482 | 3/1998 | Remington et al. | 36/61 |
| 5,836,092 | 11/1998 | Yarnell | 36/61 |

*Primary Examiner*—Paul T. Sewell
*Assistant Examiner*—J. Mohandesi
*Attorney, Agent, or Firm*—Finnegan, Henderson, Farabow, Garrett & Dunner, L.L.P.

[57] ABSTRACT

Disclosed is a golf shoe which comprises spikes provided in a lower surface of a sole. Each of the spikes is composed of a spike pin provided projectingly in the lower surface of the sole and projecting catches arranged around the spike pin. The spike pin is caused to be retractable in its axial direction and pressed to be protruded more than a tip position of each of the projecting catches. Also disclosed is a spike for a golf shoe, which comprises a spike pin and projecting catches arranged around the spike pin. The spike pin is caused to be retractable in its axial direction and pressed to be protruded more than a tip position of each of the projecting catches.

15 Claims, 1 Drawing Sheet

GOLF SHOE AND ITS SPIKE

BACKGROUND OF THE INVENTION

The present invention relates to a golf shoe and its spike, and more particularly to a golf shoe and its spike for facilitating walking not only on a soft place such as a lawn or an earth surface but also on a hard place such as a paved surface or a stone pavement by providing a spike effect.

Generally, a golf shoe includes a plurality of spikes which are provided projectingly in portions of a sole excluding its foot arch for preventing slipping of the shoe or standing firm when hitting a ball. Each spike is fixed in the sole while its spike pin is protruded from the sole. Accordingly, use of such spikes has been advantageous on a soft place such as a lawn or an earth surface. However, it has been disadvantageous on a hard place such as a paved surface or a stone pavement, because the protruded spike pin interferes with walking.

Conventionally available as means for solving the foregoing problem is, for example, Utility Model Application Laid-open Hei 7(1995)-36707 which disclosed a technology for projectingly providing a spike pin to be retractable in a sole. According to this technology, the spike pin is normally pressed to be protruded. Thus, a spike effect is provided on a soft place such as a lawn or an earth surface. On a hard place such as a paved surface or a stone pavement, the protruded spike pin is drawn in and thus walking is facilitated. However, this technology has been disadvantageous in that since no spike effects are provided on a paved surface or the like, slipping easily occurs on a rainy day or the like.

SUMMARY OF THE INVENTION

It is an object of the present invention to provide a golf shoe and its spike for facilitating walking not only on a soft place such as a lawn or an earth surface but also on a hard place such as a paved surface or a stone pavement by effectively providing a spike effect.

In order to achieve the foregoing object, according an aspect of the present invention, provided is a golf shoe which comprises spikes fixed in a lower surface of a sole. This golf Shoe is characterized in that each of the spikes is composed of a spike pin provided projectingly in the lower surface of the sole and projecting catches arranged around the spike pin, and the spike pin is caused to be retractable in its axial direction and pressed to be protruded more than a tip position of each of the projecting catches.

According to another aspect of the present invention, provided is a spike for a golf shoe which comprises a spike pin and projecting catches arranged around the spike pin. This spike for a golf shoe is characterized in that the spike pin is caused to be retractable in its axial direction and pressed to be protruded more than a tip position of each of the projecting catches.

In the foregoing structure, the spike is composed of the spike pin and the projecting catches arranged around the spike pin, and the spike pin is caused to be retractable in its axial direction and pressed to be protruded more than the tip position of each of the projecting catches. Accordingly, a spike effect can be provided by the protruded spike pin on a soft place such as a lawn or an earth surface. On a hard place such as a paved surface or a stone pavement, the spike pin is drawn in, and a spike effect is provided by each of the projecting catches. Therefore, walking can be facilitated and slipping can be prevented.

BRIEF DESCRIPTION OF THE DRAWINGS

For a more complete understanding of the present invention and the advantages thereof, reference is now made to the following description taken in conjunction with the accompanying drawings, in which;

FIG. 3(*b*) is a plan view showing an example of the spike for a golf shoe of the present invention, specifically a perspective view taken on line B—B of FIG. 3(*a*).

DESCRIPTION OF THE PREFERRED EMBODIMENTS

Figure 1:
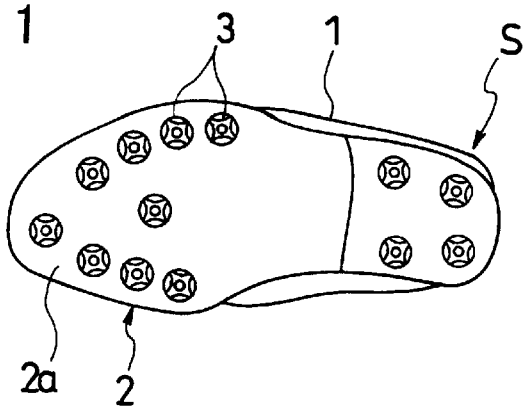
FIG. 1 is a bottom plan view showing an example of a golf shoe (for left foot) of the present invention.

Referring to FIG. 1, shown is a golf shoe S which is constructed in a manner that an outer peripheral end part of an upper 11 is joined to an upper surface outer peripheral edge part of a sole 2 by adhesives. In the tip and rear end parts of the sole 2 excluding the foot arch of a lower surface 2*a*, a plurality of spikes 3 are projectingly provided at specified intervals.

Figure 3A:
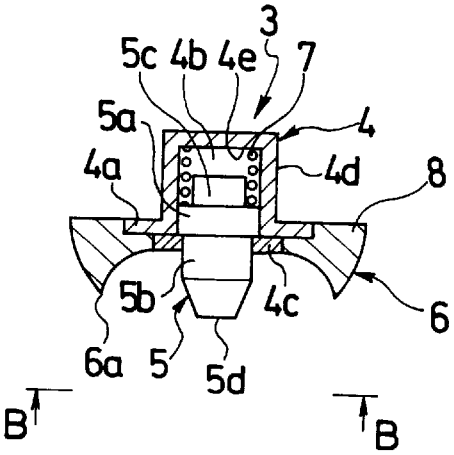
FIG. 3(*a*) is a side view showing an example of a spike for a golf shoe of the present invention, specifically a perspective view taken on line A—A of FIG. 3(*b*)
Figure 3B:
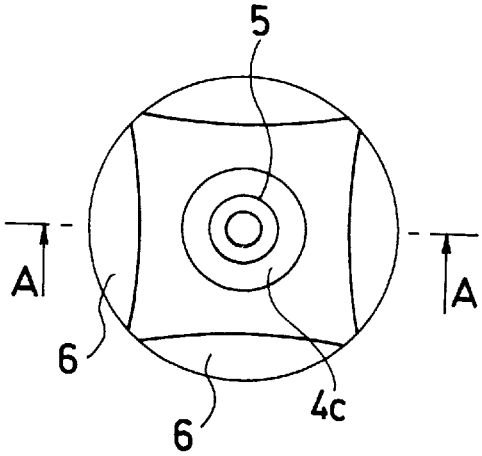

Each spike 3 is, as shown in FIGS. 3(*a*) and 3(*b*), composed of a pin holder 4, a spike pin 5 supported by this pin holder 4 and a plurality of projecting catches 6 arranged around this spike pin 5. The pin holder 4 and the spike pin 5 should preferably be made of metal. The projecting catches 6 should preferably be made of plastic. The spike 3 will now be described by referring to FIG. 3(*a*) where the pin holder 4 side is an upper side and the spike pin 5 side is a lower side.

The pin holder 4 is formed to be a cylindrical shape having a top wherein its upper end is closed. A flange 4*a* is provided to be united with an opened lower end of the pin holder 4. In a lower surface of the flange 4*a*, fixed is a regulation ring 4*c* which has an inner diameter smaller than a hollow part 4*b* in the pin holder 4. In an outer peripheral surface of the pin holder 4, a screw part 4*d* is provided. The regulation ring 4*c* should preferably be made of metal. The spike pin 5 is composed of a large diameter part 5*a* arranged in the hollow part 4*b* of the pin holder 4 so as to be freely slid up and down, a pin part 5*b* extended from the large diameter part 5*a* in a lower direction and an auxiliary part 5*c* extended from the large diameter part 5*a* in an upper direction. The large diameter part 5*a* is formed to have a diameter larger than an inner diameter of the regulation ring 4*c* and supported by the regulation ring 4*c* so as not to fall off from the hollow part 4*b*. Each of the pin part 5*b* and the auxiliary part 5*c* is formed to be a columnar shape having a diameter smaller than that of the large diameter part 5*a*. The pin part 5*b* is protruded through the regulation ring 4*c* in a lower direction. In an outer peripheral side of the auxiliary part 5*c*, provided is a contracted coil spring 7 which normally presses the large diameter part 5*a* in a lower direction.

A projecting catch 6 is provided projectingly in a lower direction to be united with a lower surface outer edge part of a plastic catch support part 8 fixed in outer peripheries of the flange 4*a* of the pin holder 4 and the regulation ring 4*c*. In FIGS. 3(*a*) and 3(*b*), four projecting catches 6 are arranged at intervals of 90°. A relationship in the amount of protrusion between the projecting catch 6 and the spike pin 5 is set such that when the large diameter part 5*a* of the spike pin 5 retractable in an axial direction is pressed by the coil spring 7 and protruded in contact with the regulation ring 4*c*, a tip (lower end) 5*d* of the spike pin 5 can be protruded lower than a tip (lower end) 6*a* of the projecting watch 6 and, when the spike pin 5 is pushed in against an elastic force of the coil spring 7 so as to bring the auxiliary part 5*c* into contact with a lower end surface 4*e* of the pin holder 4, the tip 5*d* of the spike pin 5 can be drawn in more than the tip 6*a* of the projecting catch 6. During use, the plastic projecting catch 6 is worn faster than the metallic spike pin 5 because of its lower hardness. However, since the tip 5*d* of the spike pin 5 is drawn inside more than the position of the tip 6*a* of the projecting catch 6 as described above, even if the tip 6*a* of the projecting catch 6 is worn, the spike pin 5 can be drawn in.

Figure 2:
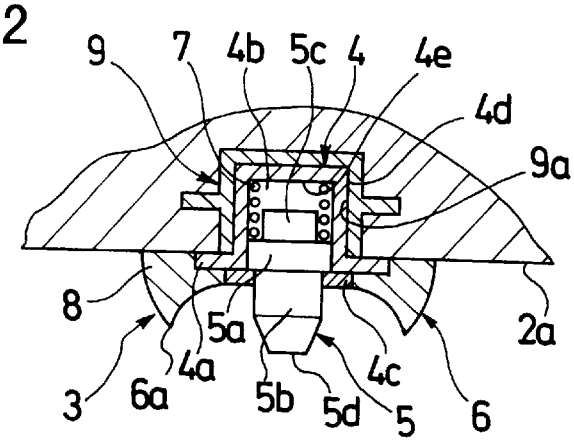
FIG. 2 is an expanded sectional view showing main portions of FIG. 1.

Fixed in the sole 2, as shown in FIG. 2, is a spike attaching metal fitting 9 which has a screw part 9*a* in its inner peripheral surface. The spike 3 is fixed to the spike attaching metal fitting 9 by the screw parts 9*a* and 4*d* so as to be detached. A golf shoe for a left foot is employed in the embodiment, but a golf shoe for a right foot is constructed to have the same structure.

As described above, according to the present invention, the spike 3 is composed of the spike pin 5 and the plurality of projecting catches 6 arranged around the spike pin 5. The spike pin 5 is caused to be retractable in an axial direction and normally pressed to be protruded more than the tip position of each of the projecting catches 6. Accordingly, a spike effect can be provided on a soft place such as a lawn or an earth surface by the spike pin 5 pressed to be protruded. On a hard place such as a paved surface or a stone pavement, the protruded spike pin 5 is drawn in and the projecting catch 6 can provide a spike effect. Therefore, walking can be facilitated and a problem of easy slipping on a rainy day or the like can be solved.

According to the invention, a conventionally known material can be used for the upper 1. For example, leather, artificial leather or cloth can preferably be used.

There is no limitation placed on materials for the sole 2, and a conventionally known material can be used. For example, polyurethane or rubber can preferably be used.

For the spike pin 5, conventionally used metal can be used. For example, steel or the like can preferably be used.

Any hard plastic can be used for the projecting catch 6. For example, nylon, polyethylene, polyester, polyvinyl chloride or polycarbonate can preferably be used.

A spring constant of the coil spring 7 should preferably be set in the range of 0.2 to 0.8 kgf/mm. If a spring constant is lower than 0.2 kgf/mm, a spring pressing force becomes too small. Consequently, it is difficult to provide a spike effect by protruding the spike pin 5 on a soft place such as a lawn or cm earth surface. On the other hand, if a spring constant exceeds 0.8 kgf/mm, a spring pressing force becomes too large. Consequently, on a hard place such as a paved surface or a stone pavement, the protruded spike pin 5 is not sufficiently drawn inside, which makes walking difficult and slipping easy on a rainy day or the like.

According to the invention, the coil spring 7 should preferably be used for pressing the spike pin 5 as described above. But the spike pin 5 may be pressed instead by an elastic member such as a leaf spring or rubber.

As apparent from the foregoing description of the present invention, since the spike is composed of the spike pin and the plurality of projecting catches arranged around the same and the spike pin is caused to be retractable in its axial direction and pressed to be protruded more than the tip position of each of the projecting catches, walking can be facilitated not only on a soft place such as a lawn or an earth surface but also on a hard place such as a paved surface or a stone pavement by effectively providing a spike effect.

Although the preferred embodiment of the present invention has been described in detail, it should be understood that various changes, substitutions and alternations can be made therein without departing from spirit and scope of the inventions as defined by the appended claims.

What is claimed is:

1. A golf shoe comprising:

a sole having a bottom surface; and spikes on the bottom surface of the sole, each of the spikes including a spike pin projecting from the bottom surface of said sole to a pin tip, and a plurality of catches arranged around the spike pin and projecting from the bottom of the sole to respective catch tips, the spike pin being axially retractable against a spring bias normally pressing the spike pin to a protruded position in which the pin tip extends beyond the catch tips.

2. A. golf shoe according to claim 1, wherein each of said spikes is detachably fixed in the sole.

3. A golf shoe according to claim 1, wherein the pin tip of the spike pin is retractable to within the catch tips.

4. A golf shoe according to claim 1, wherein said spike pin is pressed by a coil spring.

5. A golf shoe according to claim 1, wherein said spike pin is made of metal.

6. A golf shoe according to claim 1, wherein each of said projecting catches is made of plastic.

7. A golf shoe according to claim 4, wherein a spring constant of said coil spring is set in a range of 0.2 to 0.8 kgf/mm.

8. A golf shoe according to claim 1, including four of the projecting catches arranged an intervals of 90°around spike pin.

9. A spike for a golf shoe comprising:

a spike pin having a pin tip;

a pin holder to receive the spike pin;

a plurality of projecting catches arranged around said spike pin on the holder, each extending to a catch tip;

the spike pin being axially retractable against a spring bias normally pressing the spike pin to a protruded position in which the pin tip extends beyond the catch tips of the projecting catches.

10. A spike for a golf shoe according to claim 9, wherein a tip of said spike pin is drawn in more than the tip position of each of said projecting catches.

11. A spike for a golf shoe according to claim 9, wherein said spike pin is pressed by a coil spring provided in the pin holder.

12. A spike for a golf shoe according to claim 9, wherein said spike pin is made of metal.

13. A spike for a golf shoe according to claim 9, wherein each of said projecting catches is made of plastic.

14. A spike for a golf shoe according to claim 11, wherein a spring constant of said coil spring is set in a range of 0.2 to 0.8 kgf/mm.

15. A spike for a golf shoe according to claim 9, including four of the projecting catches arranged an intervals of 90° around spike pin.

* * * * *

UNITED STATES PATENT AND TRADEMARK OFFICE

CERTIFICATE OF CORRECTION

PATENT NO. : 6,079,127
DATED : June 27, 2000
INVENTORS : Toshinori NISHIMURA et al.

It is certified that error appears in the above-identified patent and that said Letters Patent is hereby corrected as shown below:

In Claim 8, column 4, line 36, "an intervals" should read --at intervals--.

In Claim 15, column 4, line 62, "an intervals" should read --at intervals--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*